US005165697A

United States Patent [19]

Lauriski et al.

[11] Patent Number: 5,165,697

[45] Date of Patent: Nov. 24, 1992

[54] BROADHEAD ARCHERY HUNTING POINT

[76] Inventors: Stanley E. Lauriski, 805 South Ave., Box 803; Rick Buesch, 805 South Ave., Box 2944, both of Aspen, Colo. 81612

[21] Appl. No.: 727,847

[22] Filed: Jul. 11, 1991

Related U.S. Application Data

[63] Continuation-in-part of Ser. No. 501,300, Feb. 23, 1990, abandoned, which is a continuation of Ser. No. 238,128, Aug. 30, 1988, abandoned.

[51] Int. Cl.[5] ..... F42B 6/08

[52] U.S. Cl. ..... 273/422

[58] Field of Search ..... 273/419–422

[56] References Cited

U.S. PATENT DOCUMENTS

| | | | |
|---|---|---|---|
| 2,137,014 | 11/1938 | Brochu | 273/421 |
| 2,350,581 | 6/1944 | Boose | 273/421 |
| 2,676,017 | 4/1954 | Selent et al. | 273/421 |
| 2,686,055 | 8/1954 | Peltz | 273/419 X |
| 2,829,894 | 4/1958 | Henkel | 273/422 |
| 2,940,758 | 6/1960 | Richter | 273/422 |
| 3,614,103 | 10/1971 | Carroll | 273/422 |
| 3,618,948 | 11/1971 | McGlocklin | 273/421 |
| 3,741,542 | 6/1973 | Karbo | 273/422 |
| 3,887,186 | 6/1975 | Matlock, Jr. | 273/422 |
| 3,915,455 | 10/1975 | Savora | 273/422 |
| 4,175,749 | 11/1979 | Simo | 273/422 |
| 4,212,463 | 7/1980 | Repinski et al. | 273/422 X |
| 4,349,202 | 9/1982 | Scott | 273/422 |
| 4,381,866 | 5/1983 | Simo | 273/422 |
| 4,529,208 | 7/1985 | Simo | 273/422 |
| 4,671,517 | 6/1987 | Winters | 273/421 |
| 4,807,889 | 2/1989 | Johnson | 273/422 |

OTHER PUBLICATIONS

Archery, Sep. 1967, p. 30, Quick-Flex.

Archery, Feb. 1977, p. 6, Fur-Long "Target".

*Primary Examiner*—Paul E. Shapiro

*Attorney, Agent, or Firm*—Dowell & Dowell

[57] ABSTRACT

A broadhead archery hunting point, or broadhead, having a ferrule and a principle blade attached to the ferrule, with a removeable, replaceable secondary blade insertable through a slot in the ferrule perpendicular to the plane of the principle blade. The secondary blade at its forward end includes a notch mating with a wedge in the end of the slot in the ferrule. When the threaded shaft of the ferrule is attached to the threaded socket of an arrow shaft, the resulting pressure created against the base of the secondary blade forces the secondary blade notch against the ferrule slot wedge while simultaneously locking the primary blade to the ferrule.

4 Claims, 2 Drawing Sheets

BROADHEAD ARCHERY HUNTING POINT

BACKGROUND OF THE INVENTION

Cross Reference to Related Applications

This application is a continuation-in-part application of Ser. No. 07/501,300 filed Mar. 23, 1990 now abandoned which is a continuation of Ser. No. 07/238,128 filed Aug. 30, 1988 now abandoned.

FIELD OF THE INVENTION

The invention relates to a broadhead archery hunting point or broadhead, and more particularly to a broadhead with a primary blade and a removeable, yet positively lockable and replaceable secondary blade, that provides penetration capacity and facility in maintaining superior sharpness of cutting surfaces.

HISTORY OF THE RELATED ART

It has been estimated that there are over two million bowhunters in the United States alone, and the number of bowhunters is increasing annually.

The broadhead used in bowhunting for dispatching popular big game animals such as deer, elk, and bear, as well as African game animals up to and including elephants, kills such game by means of promotion of hemorrhage; that is, internal bleeding as opposed to the shock or concussion produced by a rifle bullet.

In the first place, the broadhead must be capable of penetrating hide and often bone, specifically ribs in the properly placed shot, prior to penetrating vital organs, such as the lungs. The preferred lung shot results in quite rapid accumulation of fluids in the lungs, principally blood, after which the quarry soon suffocates. This is the most humane, efficient means by which a broadhead kills. Other, less humane means include the heart shot, exceedingly difficult by virtue of the small size of the heart relative to that of the lungs, and shots that attempt to sever major arteries or even the spinal cord, all of which are even more difficult to place than the heart shot.

In recent years, broadhead design has focused upon the use of soft, very thin, untempered metals. Consequently, the well known broadhead requirements of ability to penetrate the game animal hunted and facility in maintaining broadhead cutting surfaces of superior sharpness have both suffered. Inferior metals production and stamping, plus the fallacies of design employed when using these light, yet brittle, untrustworthy materials have actually decreased the efficacy of the modern broadhead in big game hunting with the bow and arrow. The use of such poorly designed broadheads manufactured of thin, brittle materials, produces more wounded, wasted game animals than should be the case.

A broadhead with a fixed principle blade and a removeable, replaceable secondary blade has been disclosed in U S. Pat. No. 2,829,894 (Henkel). In this patent the arrowhead is described as having both a fixed principle blade and a removeable, replaceable secondary blade; the latter is made of flimsy, highly malleable razor blade material. Additionally, the secondary blade is affixed to the arrowhead body, or ferrule, by means of tension pressure alone, with no fixed locking means to ensure that, upon impact, the secondary blade remains in situ. The use of this type of replaceable blade broadhead too often results in the secondary blade contacting bone, usually rib, immediately following penetration of the hide of an animal; the secondary blade then becomes broken or at least bent, and often dislodged from its holding slot in the ferrule, resulting in the secondary blade providing no purpose other than to redirect the arrow's path due to deflection, grossly impeding the penetration of the broadhead into the vital area. Further, this type of secondary blade and especially its imprecise and unlocked means of attachment to the broadhead ferrule, frequently results in the secondary blade being found floating in the organ cavity of the dead animal, and thereby represents a definite hazard to the hands, wrists, and forearms of a hunter who is field dressing the quarry.

Other prior U.S. patents pertaining to broadheads are as follows:

U.S. Pat. No. 2,137,014 (Brochu)
U.S. Pat. No. 3,614,103 (Carroll)
U.S. Pat. No. 2,350,581 (Boose)
U.S. Pat. No. 3,741,542 (Karbo)
U.S. Pat. No. 2,676,017 (Selent et al)
U.S. Pat. No. 3,887,186 (Matlock, Jr.)
U.S. Pat. No. 2,686,055 (Peltz)
U.S. Pat. No. 3,915,455 (Savora)
U.S. Pat. No. 2,940,758 (Richter)
U.S. Pat. No. 4,381,866 (Simo)

SUMMARY OF THE INVENTION

The present invention features a broadhead archery hunting point having a fixed principle blade attached to a central portion, or ferrule, by engaging in a slot in the forward end of the ferrule with the base tabs of the primary blade fitting into principle blade grooves formed in the rear portion of the ferrule body. Perpendicular to the plane of the primary blade in the ferrule is a secondary blade insertion slot, into which a secondary blade is inserted. By means of a corresponding, mating ferrule locking wedge which extends into the insertion slot and a locking notch formed in the tip of the secondary blade, the secondary blade is positively locked into the ferrule in such a manner that forward end portions of the secondary blade are protected within the insertion slot of the ferrule. The secondary blade end tabs fit into grooves in the rear portion of the ferrule and are securely held therein together with the base or end tabs of the primary blade by the threaded end of an arrow shaft.

This means of positively locking the primary and secondary blades into the ferrule absolutely ensures that the blades remain in place regardless of game animal bone and tissue encountered. Further, the forward end of the secondary blade cannot become broken or bent due to its positively locked position in the ferrule.

The ferrule locking wedge and the mating secondary blade locking notch of the present invention serve to hold the secondary blade so firmly in place that the 60–80 pound thrust of a contemporary archery hunting bow increases the efficacy of the present invention. Increased thrust upon impact results in unimpeded penetration of the present invention, due to the additional factors of relatively thick, very strong, tempered steel primary and secondary blades, and the primary and secondary blade locking means to the ferrule.

It is, therefore, an object of the present invention to provide an improved broadhead archery hunting point, which avoids the disadvantages of prior art arrowheads.

Another object of this invention is to provide a broadhead archery hunting point, the design of which performs with maximum efficacy when shot from powerful contemporary archery hunting bows, while meeting the broadhead requirements of penetration capacity and facility in maintaining superior sharpness of cutting edges while decreasing damage to the forward ends of the blades.

These and other objects of the invention will be better understood and become more apparent with reference to the following detailed description considered in conjunction with the accompanying drawings.

DESCRIPTION OF THE PREFERRED EMBODIMENT

Figure 1:
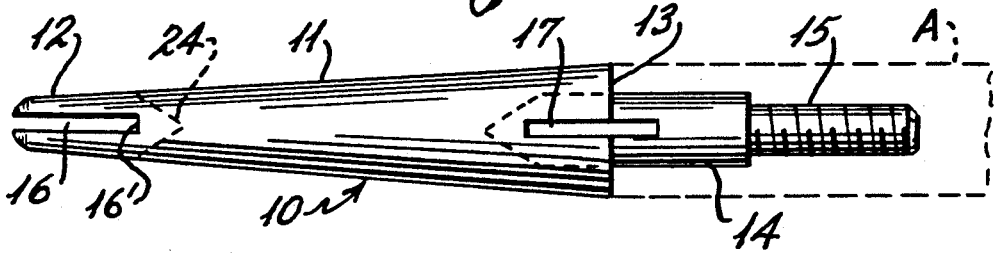
FIG. 1 is a side elevational view of the ferrule of the present invention showing the front primary blade mounting slot and rear grooves for receiving the rear tab ends of the primary blade with an arrow shaft being shown in dotted line.
Figure 2:
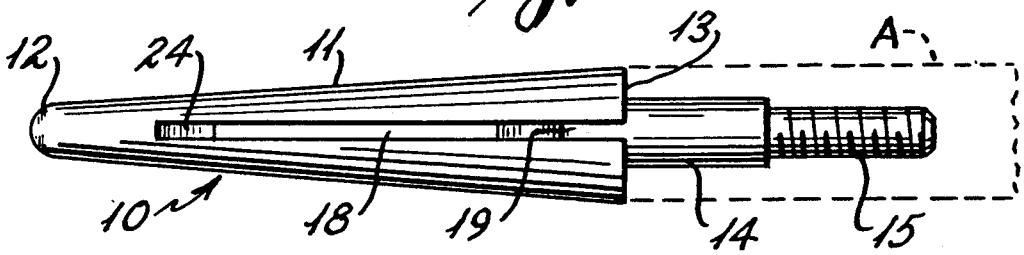
FIG. 2 is a side elevational view taken with respect to the ferrule of FIG. 1 rotated 90° showing the secondary blade insertion slot through the body of the ferrule and the grooves for receiving the rear tab ends of the secondary blade with the arrow shaft being shown in dotted line.
Figure 3:
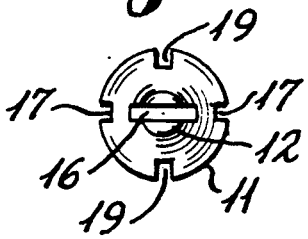
FIG. 3 is a front plan view of the ferrule shown in the position of FIG. 1.
Figure 4:
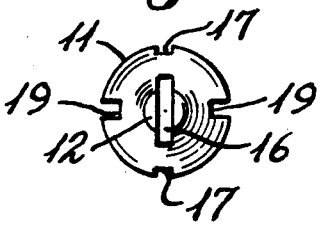
FIG. 4 is a front plan view of the ferrule shown in the position of FIG. 2.
Figure 5:
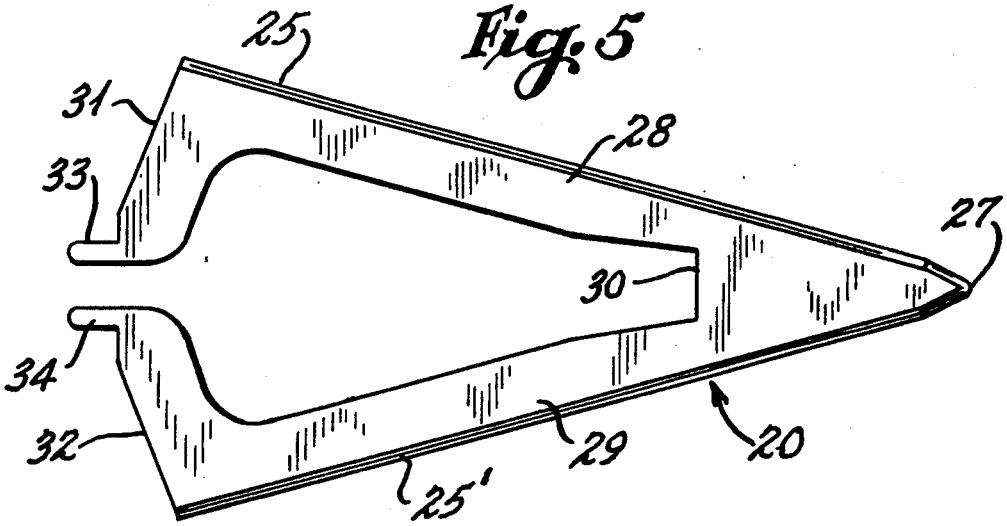
FIG. 5 is a top plan view of the primary blade of the present invention.
Figure 6:
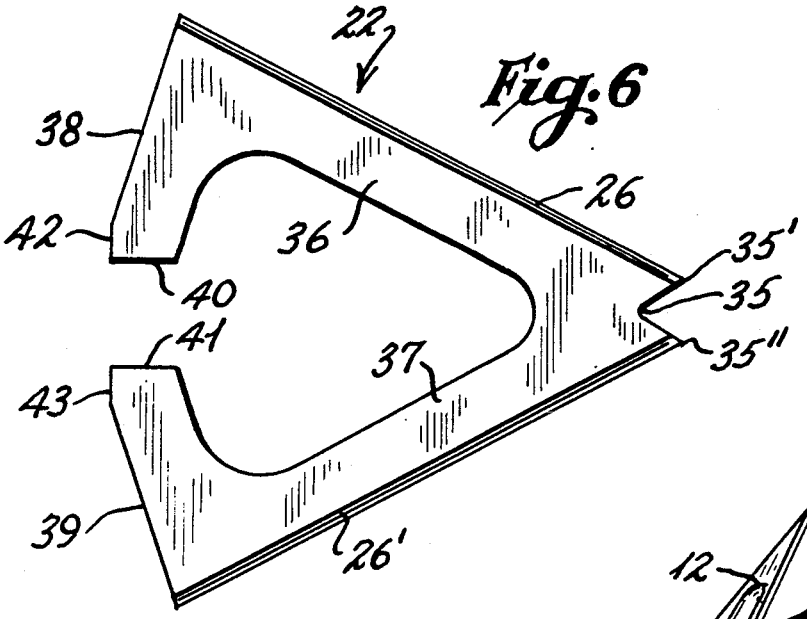
FIG. 6 is a top plan view of the secondary blade of the present invention.

Generally speaking, the present invention pertains to a broadhead archery hunting point, or broadhead, having a specially designed ferrule for mounting a principle blade and a removeable and yet positively lockable replaceable secondary blade to an arrow shaft.

With reference to the drawing figures, the broadhead includes a blade mounting ferrule 10 having a body portion 11, which is generally cylindrical in configuration. The ferrule includes a front end portion 12 and a rear shoulder portion 13. The ferrule is designed to be mounted by threadingly engaging a female socket formed in an arrow shaft A by incorporating a threaded mounting portion 15 which is connected to the main body portion 11 by way of a cylindrical shaft 14. The main body portion is primarily constructed of aluminum, however the front end portion is formed of a hardened steel which is press fitted to the aluminum portion as are the cylindrical shaft 14 and threaded end portion 15. The hardened steel components are pressed into machined cavities formed at either end of the body.

The ferrule 10 is designed to positively mount a primary blade 20 and secondary blade 22 and in this respect includes a primary blade mounting slot 16 which is formed in the front tip or end portion 12 of the ferrule which slot is aligned with spaced and coplanar grooves 17 formed in opposing sides of the ferrule adjacent the shoulder thereof. The grooves 17 extend from the body portion and along the forward end portion of the cylindrical shaft 14 of the ferrule and are provided for purposes of receiving end tabs of the primary blade as will be discussed in greater detail hereinafter.

For purposes of mounting the secondary blade to the ferrule, the present invention includes a secondary blade insertion slot 18 which is formed through the body portion 11 and which is oriented perpendicularly with respect to the slot 16 and grooves 17. The slot 18 through the ferrule is shown as being aligned with and generally continuous with respect to grooves 19 which are formed inwardly of the end wall or shoulder 13 of the ferrule, and on opposite sides thereof, for purposes of receiving end tabs of the secondary blades, also as will be discussed in greater detail hereinafter. In order to lock the secondary blades within the slots 18, a generally V-shaped locking wedge 24 is formed oriented from the tip 12 towards the rear of the ferrule so that the center portion of the locking wedge is substantially aligned with the elongated axis of the ferrule body.

Both the primary blade 20 and secondary blade 22 are formed of a tempered tool steel or stainless steel and have side cutting edges 24 and 24' and 25 and 25', respectively, which are honed to a razor sharpness during manufacture. The primary blade 20 includes a forward penetrating tip 27 from which the cutting edges 25 and 25' extend along two leg portions 28 and 29 of the blade. A shoulder 30 is formed at the junction between the leg portions 28 and 29 and is of a size to cooperatively seat within the slot 16 so as to engage the end wall 16' of the slot when the blade is mounted to the ferrule 10. The rear portion of the primary blade includes a pair of inwardly extending tabs 31 and 32 which are slightly yieldable with respect to one another due to the enlarged opening formed between the leg portions 28 and 29. The endmost portions of the tabs 31 and 32 are formed as elongated flanges 33 and 34, respectively, which are of a size to be fully seated within the grooves 17 formed in each side of the ferrule. In view of the foregoing, the primary blade is mounted to the ferrule by sliding the blade rearwardly relative to the forward portion of the ferrule until the shoulder 30 has seated against the end wall 16' of the slot 16. In this position the tab portions 31 and 32 will snap into the grooves 17 on either side of the ferrule in such a manner that the flanges 33 and 34 are fully seated therein and will not extend outwardly with respect to the cylindrical shaft 14 of the ferrule. In this manner, when the arrow A is threaded onto the threaded portion 15 of the ferrule, the end portion of the arrow will overlap the flanges 33 and 34 thereby retaining the primary blade in locked position relative to the arrow shaft. Therefore, the flange 33 and 34 extend outwardly from the shoulder portion 13 of the ferrule along the outermost portions of the grooves 17 so that these portions of the blade extend under the forward end of the arrow A when the ferrule is mounted to the arrow shaft.

Figure 7:
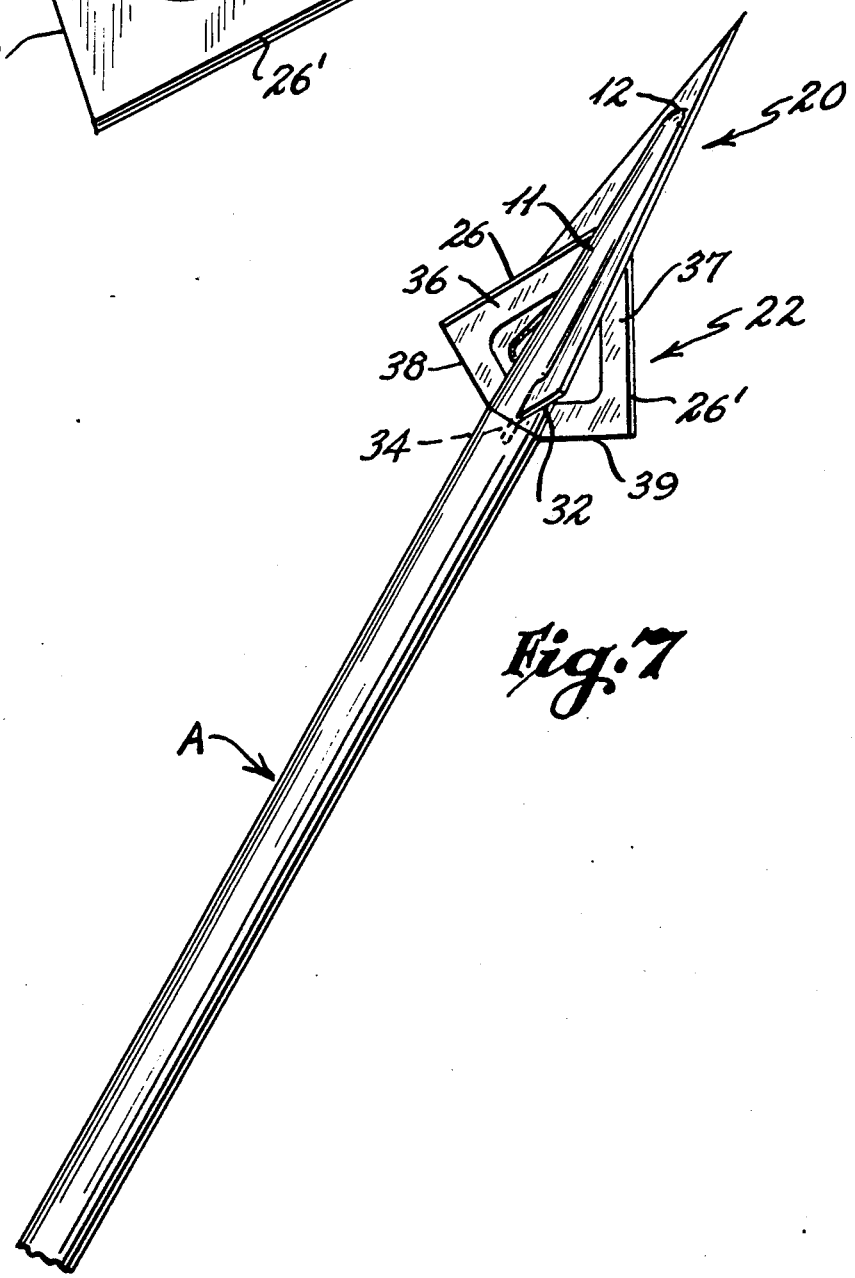
FIG. 7 is a perspective view showing the arrow shaft as it engages the tab ends of both the primary and secondary blades to retain the blades within the ferrule.

The secondary blade 22 also includes a forward portion which is shaped as a V-shaped notch 35 from which the cutting edges 26 and 26' extend along opposing leg portions 36 and 37. The notch 35 is designed to be cooperatively seated against the V-shaped wedge 24 which extends into the slot 18 of the ferrule body 11. It should be noted that the notch 35 is defined by opposing points 35' and 35'' which points are designed to extend within the body of the ferrule 11 so that they are protected within the body of the ferrule when the secondary blade is mounted within the ferrule as shown in FIG. 7. In this regard, the points 35' and 35'' are oriented within the slot 18 when the secondary blade is mounted within the ferrule body.

The secondary blade also includes rear tab portions 38 and 39 having opposing end portions 40 and 41, respectively, which are designed to be cooperatively seated within the grooves 19 formed on either side of the ferrule body. Further, each of the tabs 38 and 39 includes a bevelled end wall 42 and 43 which align with the shoulder portion 13 of the ferrule when the secondary blade is fully seated within the slot 18.

In order to mount the secondary blade within the slot 18, one of the leg portions 36 or 37 is inserted through the slot and thereafter the blade pivoted with the notch portion 35 oriented rearwardly of the locking wedge 24. Once the blade is aligned axially within the slot the arrow shaft is rotated to secure the arrow to the threaded end portion 15 of the ferrule. As the arrow shaft is threaded toward the shoulder 13 of the ferrule, the end of the arrow will engage the end walls 42 and 43 of the secondary blade and urge the blade to a position where the notch 35 is fully engaged against the locking wedge 24 of the ferrule. In this manner a positive lock is established to prevent the secondary blade from being accidently displaced relative to its seated position within the ferrule.

From the foregoing, it should be noted that both the primary and secondary blades of the invention may be easily replaced or dismounted for sharpening as may be necessary. Further, the mounting arrangement allows for the primary blade to be utilized without the secondary blade and when the secondary blade is used, however, the secondary blade is mounted in such a position that the forward end portion thereof is fully protected so that the tip or pointed portions 35' and 35'' of the blade cannot be directly engaged with any bone or other tissue through which the blade may pass during the use of the broadhead for hunting purposes.

Further, each of the blades is securely locked to the ferrule by the action of the arrow shaft which overlaps the flanges 33 and 34 and abuts the end tabs 31 and 32 of the primary blade while simultaneously urging the secondary blade against the locking wedge 24 as the shaft is threaded on the threaded end portion 15 of the ferrule.

In some embodiments it may be desirable to provide a pin (not shown) which could be inserted through the tip portion 12 and primary blade 20 to further lock the primary blade in position within the slot 16.

We claim:

1. A broadhead archery hunting point for game hunting which is designed to be selectively receivable within a threaded socket formed in the leading end of an arrow shaft comprising, a ferrule having a body portion including a forward end and shoulder portion spaced from said forward end, said ferrule also having a threaded base portion, said threaded base portion being selectively receivable within the threaded socket of the arrow shaft so that the arrow shaft engages said shoulder portion, a first slot formed in said forward end of said ferrule and a second slot formed through said body portion of said ferrule and spaced from said forward end, said second slot being oriented perpendicularly with respect to said first slot, said ferrule including a locking wedge extending into said second slot, a first pair of oppositely oriented grooves in said body portion of said ferrule and extending from adjacent said shoulder portion toward said threaded base portion, said first pair of grooves being generally coplanar with said first slot, a second pair of oppositely oriented grooves formed in said body portion of said ferrule and communicating with said shoulder portion thereof, said second pair of grooves being oriented generally perpendicularly with respect to said first pair of grooves, a primary blade having a forward tip and a pair of opposing legs, a shoulder formed between said legs and a pair of spaced primary end tabs extending toward one another remote from said tip, each of said primary end tabs including a rearwardly extending flange, said primary blade being seated with respect to said ferrule with said shoulder within said first slot and said flanges of said primary end tabs being seated within said first pair of grooves, a secondary blade having a leading end and a pair of leg members extending therefrom having secondary opposing end tabs at the opposite ends thereof, a notch formed in said leading end of said secondary blade and defined by spaced end points, said secondary blade being seated within said second slot so that said locking wedge is in engagement with said notch and said secondary end tabs ar seated within said second pair of grooves, said end flanges of said primary end tabs being covered by said arrow shaft when said arrow shaft is threaded to said threaded base portion of said ferrule and said secondary end tabs of said second blade being substantially simultaneously engaged by the leading end of the arrow shaft as said base portion of said ferrule is threaded into the socket of the arrow shaft to thereby positively and simultaneously lock said primary and secondary blades to said ferrule.

2. The broadhead archery hunting point of claim 1 in which said spaced end points of said secondary blade are oriented within said second slot of said ferrule.

3. The broadhead archery hunting point of claim 2 in which the leading edge of the arrow shaft engages both said primary and secondary end tabs of said primary and secondary blades when the arrow shaft is threaded to said base portion of said ferrule.

4. The broadhead archery hunting point of claim 1 in which said locking wedge and said notch have complementing V-shapes.

* * * * *